US007252565B2

(12) United States Patent
Hunter

(10) Patent No.: US 7,252,565 B2
(45) Date of Patent: Aug. 7, 2007

(54) ELECTRICAL CONNECTOR

(75) Inventor: Andrew Hunter, Glasgow (GB)

(73) Assignee: Thales Holdings UK PLC, Surrey (GB)

( * ) Notice: Subject to any disclaimer, the term of this patent is extended or adjusted under 35 U.S.C. 154(b) by 0 days.

(21) Appl. No.: 10/564,763

(22) PCT Filed: Jul. 7, 2004

(86) PCT No.: PCT/EP2004/051400

§ 371 (c)(1),
(2), (4) Date: Jan. 17, 2006

(87) PCT Pub. No.: WO2005/015583

PCT Pub. Date: Feb. 17, 2005

(65) Prior Publication Data

US 2006/0176639 A1 Aug. 10, 2006

(30) Foreign Application Priority Data

Jul. 17, 2003 (GB) ..... 0316738.4

(51) Int. Cl.
*H01R 9/22* (2006.01)

(52) U.S. Cl. ..... 439/950; 439/352

(58) Field of Classification Search ..... 439/950, 439/352, 357

See application file for complete search history.

(56) References Cited

U.S. PATENT DOCUMENTS

| | | | | |
|---|---|---|---|---|
| 4,144,485 | A | 3/1979 | Akita | |
| 4,303,902 | A | 12/1981 | Lesster et al. | |
| 4,876,535 | A | 10/1989 | Ballmer et al. | |
| 5,385,476 | A * | 1/1995 | Jasper | 439/38 |
| 5,626,491 | A | 5/1997 | Hasirgoglu | |
| 6,219,231 | B1 * | 4/2001 | Nabetani et al. | 361/684 |
| 6,319,031 | B1 | 11/2001 | Greenstein | |
| 6,476,520 | B1 | 11/2002 | Lang et al. | |

FOREIGN PATENT DOCUMENTS

| | | |
|---|---|---|
| DE | 196 21 003 A | 11/1997 |
| EP | 0 394 714 A | 10/1990 |
| EP | 1 077 511 A | 2/2001 |

OTHER PUBLICATIONS

Pedder D A G et al: "A Contactless Electrical Energy Transmission System" IEEE Transactions on Industrial Electronics, IEEE Inc. New York, US Feb. 1, 1999.

* cited by examiner

*Primary Examiner*—Truc Nguyen
(74) *Attorney, Agent, or Firm*—Lowe Hauptman & Berner, LLP

(57) ABSTRACT

The present invention may provide a two-part electrical connector having

- a first part being a tongue portion having a base and a tongue extending longitudinally therefrom;
- a second part being a socket portion having a base and walls extending therefrom defining a socket for slidably receiving the tongue, the tongue portion and socket portion having locking means to permit releasable mutual engagement, said locking means including a locking member moveable between a first position in which the tongue is held in the socket and a second position in which the tongue is removable from the socket;
- a primary coupling element located in the tongue; and
- a secondary coupling element located in at least one of the socket walls, which elements provide a contact-less electromagnetic coupling when the tongue is engaged in the socket.

22 Claims, 8 Drawing Sheets

5A

5B

Fig 4
4A
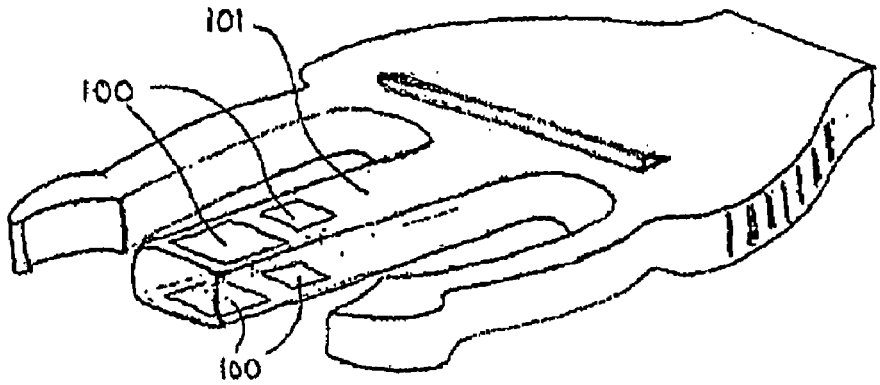
4B
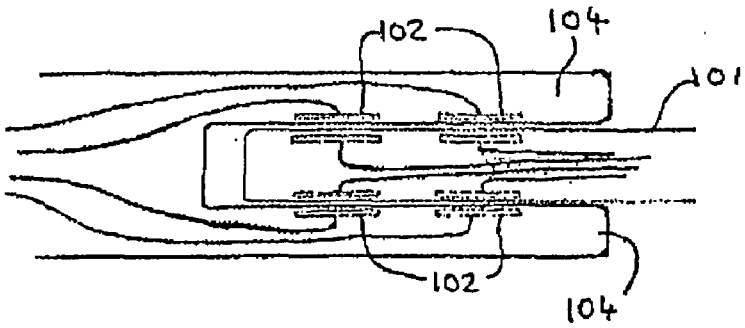

5A
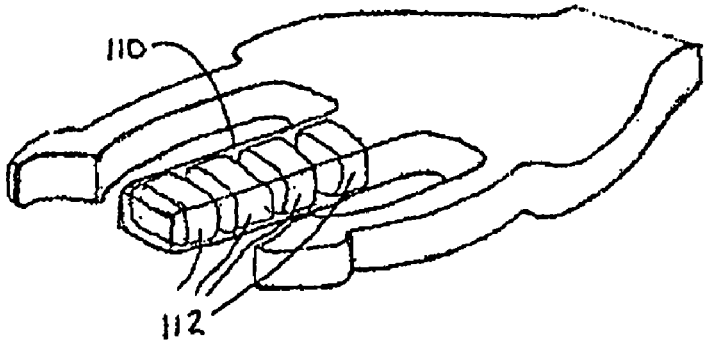
5B
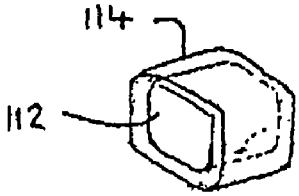

ELECTRICAL CONNECTOR

TECHNICAL FIELD

This invention relates to electrical connectors and in particular contact-less electrical connectors, that is electrical connectors where there is no direct contact between electrical conductors.

BACKGROUND OF THE INVENTION

The use of portable or hand-held electrical equipment in harsh outdoor environments and in particular by soldiers in combat environments is becoming commonplace. It is desirable and sometimes essential that such equipment be repeatedly connected and disconnected to a power supply and/or other electrical equipment so that the equipment can perform its function and be stowed when not in use.

Electrical connectors currently used in combat environments employ direct electrical contacts and a sealing mechanism to protect the connector. Typically, the sealed connectors are circular and use a threaded connection. Examples of these sorts of connectors are MIL-STD-1760 and MIL-STD-38999 connectors.

In contrast to these direct contact connectors, the present invention relates to contact-less connectors, and in particular inductively coupled connectors, and so some discussion of this type of technology is useful.

In an inductive connector there is no direct transfer of electrical energy from one connector part to the other. Instead the electrical energy is inductively coupled from one connector part to the other in the same manner as in a transformer. Similarly, in a capacitive connector, electrical energy is transferred from one connector to the other across a dielectric in the same manner as in a capacitor.

The principal of contact-less or indirect electromagnetic coupling has been employed to transfer electrical power between electric vehicles and charging stations (WO98/31073) and between under water electrical cables (U.S. Pat. No. 4,538,863 and GB2,136,635).

These connectors employ pairs of inductors, one in each half of the connector, each having a conductive winding around a ferromagnetic core. The inductors are located at the end of respective halves of the connector such that when connected the two halves of the connector are in face to face orientation to produce end-on mating of the two inductors.

The two parts of the connectors are generally held securely together by bolts, screw threads or even hydraulic actuators, thereby ensuring a tight fit and reliable long term connection.

An inductive connector has also been used to transmit measurement signals from a transmission line to a sensor and again an end-on orientation is disclosed (US2002/0102884).

The provision of electrical connectors suitable for use in harsh outdoor environments as part of equipment that is to be carried or worn by an individual and in particular by soldiers in a combat environment is becoming increasingly important. As noted above, this is because the use of electrical equipment by, for example, soldiers and other military personnel is becoming increasingly commonplace. Connectors used in these environments must be robust enough to stand up to the rigours of the outdoor environment whilst being light and small enough so as not to impede the mobility of the individual. In addition the electrical connection made by the connector must be reliable and accurate so that the electrical equipment in question can perform its function.

The inventors of the present invention have realised that conventional direct contact electrical connectors have a number of drawbacks when employed in environments such as those experienced by military personnel in training and in combat.

Firstly, repeated opening and closing of any direct contact electrical connector will inevitably involve wear and tear of the contact surfaces, especially if significant power is passing through the connector at the time the connector is disconnected since this may cause arcing and oxidation at the contact surface. This results in degraded performance over time and can reduce the lifespan of the connector and/or equipment and increase maintenance costs.

Secondly, when electrical connectors are opened and closed in these environments there will inevitably be some dirt, dust or liquid that contaminates one or both halves of the connector. In a simple direct contact conductive connector, any dust or dirt on the contact surfaces will reduce the efficiency of the electrical connection with the result that the equipment may function incorrectly, inefficiently or not at all. Conventional connectors do not cope well in the environments experienced by soldiers, in particular immersion in salt water, the ingress of sand and exposure to chemical warfare agents.

SUMMARY OF THE INVENTION

At its most general the present invention proposes that mechanical strength and durability may be provided in a two-part tongue and socket connector in which an extended overlap between electromagnetic coupling elements in the tongue and socket is provided in the direction in which the connector is opened and closed so that some movement of the tongue within the socket is permitted whilst maintaining electromagnetic coupling.

In one aspect, the present invention provides a two-part electrical connector, said connector having a first part being a tongue portion having a base and a tongue extending longitudinally therefrom;

a second part being a socket portion having a base and walls extending therefrom defining a socket for slidably receiving the tongue, the tongue portion and socket portion having locking means to permit releasable mutual engagement, said locking means including a locking member moveable between a first position in which the tongue is held in the socket and a second position in which the tongue is removable from the socket;

a primary coupling element located in the tongue; and a secondary coupling element located in at least one of the socket walls, which elements provide a contact-less electromagnetic coupling when the tongue is engaged in the socket.

The present inventors have realised that there are significant advantages if a connector used in harsh outdoor environments by, for example, military personnel is capable of being rapidly opened and closed. Conventional direct contact connectors in this field do not provide this functionality. Conventional designs focus on providing a seal against the environment and this is at the expense of any kind of "quick release" functionality.

A connector used in these environments will be subjected to rough handling and constant knocks and bangs. Any movement of one half of the connector relative to the other may break the direct electrical connection in conventional connectors.

Known direct contact connectors minimise movement by engineering very fine tolerances between the two halves of the connector to prevent movement, but this makes the whole design more susceptible to the problem of dust and dirt and to the inevitable wear and tear of repeated opening and closing. In contrast the present invention preferably permits some relative movement of the two parts.

An advantage of the present invention is that it incorporates the functions of a mechanical connection and an electrical connection in a single connector, thereby removing the need for a separate strap connector (for mechanical strength) and wire connector (for electrical connection).

The inventors of the present invention have surprisingly found that contact-less electrical connectors can be employed in harsh outdoor environments where repeated opening and closing of the connector is required and where the connector is to form a mechanical connection for equipment carried by an individual. This is surprising because known contact-less connectors are of a size and design that is quite inappropriate to be carried or worn by an individual in these environments. Furthermore, known contact-less connectors do not provide both strong mechanical connection and the ability to rapidly and precisely open and close the connector by hand. What is more, known contact-less connectors would be susceptible to the ingress of dirt, dust and liquid if they were to be opened and closed repeatedly in the type of environments discussed above.

Preferably the primary and secondary coupling elements overlap and provide an electromagnetic connection along at least one of the socket walls. This arrangement has the advantage that any dirt or dust which is introduced into the socket will be less likely to interfere with the coupling than would be the case were the coupling elements to be located in the base of the socket portion and the tip of the tongue respectively because dirt and dust will tend to aggregate at the base of the socket, due to the action of the tongue repeatedly entering the socket.

Therefore the present invention addresses both known and previously unrecognised drawbacks associated with conventional direct contact conductive connectors and employs technology based on contact-less electrical connectors. At its broadest the present invention provides a two-part contact-less electrical connector which may be carried or worn by an individual such as a soldier for transmitting data and/or power in harsh outdoor environments and in particular a battlefield environment where dust and dirt may be a problem.

Preferably the primary and secondary coupling elements overlap when the tongue is engaged in the socket and this overlap enables electromagnetic coupling to occur. The coupling elements may for example be inductor or capacitor structures and so the overlap between the coupling elements may be regarded as a magnetic flux overlap or a dielectric charge overlap respectively.

Data and/or power may be transmitted through the connector in either or both directions.

The two-part connector typically connects two or more wires so that electrical signals can be transmitted between them. Suitably the first part and second part of the connector are respectively joined to ends of the two wires. Preferably, where multiple wires carrying e.g. multiple data signals are to be connected the transfer of the signals may be accomplished by multiplexing in the time domain or the frequency or phase domain. Alternatively, two or more pairs of coupling elements may be incorporated into the connector so that the data or power signals can be transmitted simultaneously.

Alternatively, one part of the connector (e.g. the first part or the second part) may be fixed on a piece of equipment and the other part is moveable to be engaged by the fixed part.

Preferably the connector has a flat profile that allows the connector to fit more comfortably against the body of the wearer.

Preferably the secondary coupling element extends along the socket walls to provide an extended overlap to permit a degree of flexibility in the fit of the tongue in the socket. More preferably, the secondary coupling element extends longitudinally along the walls of the socket so that there is an extended overlap in the direction of engagement. This is particularly advantageous because the connector will typically have to accommodate considerable stresses in normal use, particularly along the direction of engagement where forces exerted on the wires, cabling or straps on either side of the connector will be transmitted to the connector and so some movement of the tongue relative to the socket is quite likely. The present invention allows this movement whilst maintaining effective electromagnetic coupling. This added flexibility means that simple locking means which provide a "quick release" functionality, for example the squeeze-to-release arrangements found on rucksacks, can be employed to provide a robust "quick release" mechanical connection, as described below. The combination of a simple mechanical connection and contact-less electromagnetic coupling with an extended coupling overlap in the direction of engagement provides a robust and useful connector for use in harsh outdoor environments.

Preferably, the primary coupling element extends longitudinally adjacent an outer surface of the tongue, preferably parallel to the surface of the tongue, and the secondary coupling element extends longitudinally adjacent a corresponding inner surface of a socket wall, preferably parallel to the surface of the wall, so that in use overlap of the primary and secondary coupling elements permits lateral and/or longitudinal movement of the tongue within the socket whilst maintaining electromagnetic coupling.

By "maintaining electromagnetic coupling" it is meant maintaining an electrical connection which permits data and/or power transfer. Preferably the data and/or power signal is transmitted by the connector without substantial loss of data and/or power. In the case of power transfer, preferably the power loss should be no more than 35%, more preferably no more than 25%, and most preferably no more than 15%. Where the connector is transferring data signals, suitably the signal loss is no more than 30 dB, preferably no more than 20 dB and more preferably no more than 10 dB.

Preferably, the present invention reduces the complexity of the connector and removes the need for providing separate mechanical and electronic connections.

Thus preferably the connector of the present invention performs the function of providing a load bearing mechanical connection that can, for example, support the weight of the equipment being carried.

Preferably the connector is made from a plastics material, more preferably a high impact plastics material. Suitably the connector is made from a resilient material. Preferably the connector is made from a material that is resistant to chemical warfare agents and decontaminating agents so that it can be used in military combat environments. An example of a material that could be used to make the body of the connector is nylon 66. Suitably, the material is a composite, for example nylon reinforced with glass fibres.

Typically, the coupling elements and/or electronic circuitry for controlling the connector are embedded in the material from which the connector is formed. This serves to protect these components during use of the connector.

The wires and/or cables that are joined to respective ends of the connector are preferably part of a strap or webbing so that the connector and the wires can carry the weight of the equipment. Suitably the wires may be incorporated into conventional straps or webbings used, for example, by soldiers to carry their equipment. Preferably the present invention therefore also provides contact-less connectors as described herein having straps and/or harnesses in which are embedded the cables or wires which are to be connected so that electrical equipment can be easily carried and operated without the inconvenience of a separate strap/harness and electrical wire/cable.

Preferably, a contact-less connector of the present invention in the form of a mechanical webbing buckle combines the strength of a mechanical fastening with the functionality of power and data transfer.

Suitably, the main body of the connector provides the mechanical connection function and physical protection for the termination of the webbing wires.

Preferably, the contact-less connector of the present invention permits simple and rapid opening and closing of the connector by providing a locking means such as a latch, catch or fastener. The locking means provides a "quick release" functionality and ensures a strong mechanical connection whilst permitting quick and easy opening and closing of the connector. A preferred example of locking means is that of the squeeze-sides-to-release clips found on rucksacks. Another preferred example is a connector in which a central resilient latch is provided on one side of the tongue and a detent in the corresponding socket wall.

The provision of locking means minimises the time spent by the user in opening and closing the connector whilst ensuring that the tongue and socket portion are correctly oriented with respect to one another to provide efficient electrical coupling. Such locking means permit opening and closing of the connector even when the user is wearing gloves.

As noted above, the structure of a preferred connector is externally that of a squeeze-to-release type plastic buckle as typically found on a rucksack. Internally it makes use of the generic topology of this type of buckle modified to contain the primary and secondary coupling elements. Additionally, the electronics that control the electrical coupling process are contained in the body of the buckle.

Preferably the connector has a "self-cleaning" structure that permits the socket to be cleaned by the action of engaging the tongue in the socket. Preferably such a "self-cleaning" arrangement, whereby dirt and dust is removed from the socket, is achieved by providing a gap, aperture or opening in at least one of the socket walls that permits dirt and dust to escape from the socket when the tongue is engaged in the socket. Suitably the gap or gaps are located towards the rear of the socket portion near to or adjacent the base of the socket portion. Preferably this arrangement enables the "piston" action of the tongue entering the socket to push dirt and dust into a rear part of the socket where it can escape through the gap or gaps provided.

In the connector of the present invention the coupling elements are located in the socket walls and the tongue and so preferably the "piston" action of the tongue entering the socket and forcing dirt and dust out of the socket via the gap or gaps in the socket walls ensures that there is no build up of dirt or dust on the socket walls.

Preferably the combination of a coupling element in at least one of the socket walls and a self-cleaning structure, for example, the provision of gaps or apertures in the socket walls, permits coupling between the coupling elements even in harsh outdoor environments because dirt and debris will be forced towards the base of the socket portion where it can escape through the apertures, thereby leaving the surfaces of the socket walls free of dirt.

The "self-cleaning" structure also has the added advantage that it makes the socket portion easy to clean, for example by rinsing with water to flush dirt and dust through the socket.

In a particularly preferred arrangement the socket portion includes two baffles located within the socket defining a guide channel for guiding the tongue, the baffles extending from the mouth end of the socket to a point spaced from the base of the socket portion so that dirt and debris pushed into the guide channel by the tongue can escape from the guide channel through the space between the socket base and the baffles.

Preferably, where the socket portion includes such baffles or internal walls, the tongue portion may include a tongue having two, three or more parts, each part extending longitudinally from the base of the tongue portion so that each part is slidably receivable in a part of the socket defined by the socket walls and baffles or internal walls.

The coupling elements preferably provide inductive or capacitive coupling, but any near field antenna arrangement that provides electromagnetic coupling without direct contact of electrical conductors may be used. In principle it would be possible to provide a pair of electromagnetic antennae, one in each half of the connector so that when the connector is closed the antennae are in near field proximity, data and/or power transmission can occur.

Preferably, the coupling elements permit transmission of data signals or electrical power, or simultaneous or sequential transmission of both.

Preferably, the electromagnetic coupling is provided by inductive coupling and the primary and secondary coupling elements are inductors. At their simplest the inductors typically comprise a conductive coil wound around a ferromagnetic core, but any arrangement of a conductive coil and a core that is capable of generating a flux that can be detected by another inductor may be used.

Suitably, the secondary coupling element extends from the socket base into at least one of the socket walls. Preferably, the ferromagnetic core of the secondary coupling element has two or more elongate arms that extend from the socket base along the socket walls to provide an extended inductive overlap area within the socket. This means that there is considerable flexibility as to the location of the primary inductor with respect to the secondary inductor and so some movement of the tongue within the socket is possible.

In a preferred connector the socket walls define a substantially cuboid socket for receiving a tongue of corresponding shape and the elongate arms of the secondary coil extend along opposite facing walls to provide an induction zone in which the primary inductor can be located to provide inductive coupling. This arrangement can be adapted to accommodate different locking means, for example the elongate arms may extend along opposing side walls of the socket so as to accommodate a locking means located on an upper surface of the tongue and in an upper wall of the socket. Conversely, the elongate arms may extend along opposing upper and lower walls so as to accommodate a locking means located on a side of the tongue and in corresponding side walls of the socket.

The primary inductor may extend along the tongue in a longitudinal direction so that an even greater inductor overlap is achieved.

Preferably, the primary inductor core has two or more elongate arms that extend longitudinally along the tongue. In this arrangement the primary coil and the primary core surrounded by the coil is typically located in a rear portion of the tongue, or in the base of the tongue, and the elongate arms of the core extend to a forward portion of the tongue.

In a preferred arrangement both the primary inductor and the secondary inductor have elongate arms. Preferably, in this arrangement the two pairs of elongate arms may be located in side walls of the tongue and socket, leaving the upper and lower walls free to accommodate locking means, or in upper and lower walls of the tongue and socket, leaving the side walls free to accommodate locking means.

Suitably, the ferromagnetic cores are made from a "soft" ferrite material, although any ferromagnetic material may be used, for example permalloy or a ceramic. The specific material used will depend on the inductor design, for example the operating frequency and the dimensions of the core. Suitable materials are known in the art.

Preferably, the present invention provides contact-less inductive connectors in which the inductor cores are made from ferrite particles dispersed in a resilient matrix. Suitably the resilient matrix is a plastics material. The use of mechanically compliant inductor cores of this type means that the connector can be provided with some flexibility to further simplify the opening and closing of the connector and to reduce the cost of the connector by relieving the requirement for high tolerances between the components. In some embodiments, it is only the elongate arms that are made from this mechanically compliant material.

A preferred feature of the present invention is the use of inductor cores having elongate arms wherein the elongate arms are spaced from the main part of the inductor core that is surrounded by the conductive coil so that some independent movement of the elongate arms with respect to the main part of the core is possible. The size of the spacing is such that a magnetic flux may be transmitted between the main part of the core and the elongate arms. The size of the spacing will depend on whether the connector is to be used to transfer data or power. Power transfer requires a smaller spacing than data transfer. Preferably the spacing is less than 0.1 mm, more preferably less than 0.05 mm and most preferably less than 0.01 mm. Where the elongate arms are spaced apart from the main part of the core in this way, the arms may be made from a mechanically compliant material as described above to provide optimum mechanical flexibility to the inductor structure.

The contact-less electrical connector of the present invention may be a capacitive connector wherein the electromagnetic coupling is provided by a capacitor structure formed when the tongue is engaged in the socket. In a capacitive connector each half of the connector contains one half of a capacitor structure.

A capacitive connector may be particularly suitable for data transmission at high frequencies, for example 1 Megahertz and above.

Preferably, the tongue and socket portion each contain a capacitor plate such that when the tongue is engaged in the socket the two plates overlap to form a capacitor structure. In another preferred arrangement the capacitor structure is provided by conductive rings in the tongue and socket walls that are concentric when the tongue is engaged in the socket. Suitably, the primary coupling element includes a ring of conductive material that extends around the circumference of the tongue and the secondary coupling element includes a ring of conductive material that extends around the corresponding internal surface of the socket so that when the tongue is engaged in the socket the primary rings are located within the secondary rings.

Where reference is made in this section to primary or secondary components or first or second parts or components it is meant only as an example and the parts and components in question may in fact be in either the first or second part and therefore be either primary or secondary components.

The electronics preferably used to drive the primary and secondary coupling elements are preferably located in the base parts of the socket and tongue portions. In the case of electrical power transfer by induction, the drive circuitry for the primary side of the link is preferably contained within the connector body.

Preferably, control electronics are provided to automatically detect the presence of the mating circuit in the other part of the connector. This may be achieved by, for example, detecting the change in impedance of the primary circuit caused by the proximity of the secondary coupling element (or vice versa). Suitably, this may also be achieved by detecting the change in phase between the current and voltage (quadrature) when the two parts of the connector are connected and disconnected. Preferably, the control electronics "fold back" or reduce power to the primary coupling element when the secondary element is not recognised.

Preferably, the secondary coupling element may be linked with such circuitry as to provide a regulated output voltage using the principles of various existing switch mode power supplies.

Where a magnetic coupling is used to transfer data and/or power, preferably there is a control circuit in the first part of the connector that monitors the load impedance.

Preferably the winding of the primary inductor is fed a "square wave" by "chopping" a DC supply. Preferably, power is transferred at 10 kHz to 300 kHz, e.g. at about 200 kHz, and preferably data is transferred at about 10 kHz to 3 MHz, e.g. at about 200 kHz. Preferably, the present invention provides the use of a two part electrical connector as described herein for transmitting power and/or data at these frequencies. The exact frequency is determined by calculating the optimal efficiency based on the core material and geometry and the loss characteristics of the electronics controlling the connector. This may be achieved, for example, with a known arrangements of 4 Field Emission Transistors (FET) forming an 'H' bridge.

Preferably this allows the current to reverse in the magnetic circuit thus reducing the threshold for saturation of the core.

The core of the inductor is preferably operated with no net DC current flowing in the conductive coil so as to increase the amount of flux the core can support without reaching saturation.

Preferably the data and/or power transfer is controlled by monitoring the voltage waveform and current waveform by feeding them into a Phase Lock Loop (PLL); the PLL preferably measures the phase of the current vs. the voltage and thus measures the complex impedance of the load.

Preferably control logic is used which is able to measure instantaneous voltage, current and phase difference (quadrature) to maintain the inductor within its safe operating envelope and to determine whether the secondary inductor is engaged.

Preferably based on this measurement the circuit controlling the 'H' bridge then decides whether the secondary is present and therefore whether the full voltage should be switched to the primary or, in the case of the secondary not being present/or faulty, to limit the amplitude or active duration of the 'on' period of the 'H' bridge.

Thus by continuously monitor the status of the connector in either 'working' mode or disconnected/faulty mode the control circuit can simply adopt the correct response.

Preferably data can be transferred by several methods, for example:

Modulation of the frequency of the DC chopping, for example a 10% frequency modulation above 200 kHz provides a 20 kHz out-bound data link and this would have little effect on the design of the magnetic circuit.

Alternatively, the power drive waveform can be a digital message in itself, preferably by using a standard protocol for a DC balanced system, for example any non-return to zero code that will avoid saturation of the coupling element.

The connection can be made bi-directional, for example power and data may be transferred in either or both directions. Preferably transfer is achieved by time multiplexing access to the coupling element. Suitably this requires a protocol to manage the link and preferably a simple micro-controller in each half of the connector.

Communication between the two parts of the connector can take place for example by modulation of the frequency of DC chopping as explained above for the outbound signal and for example by deliberate modulation of the circuit impedance in the second part to reflect data back into the monitoring circuit of the first part. If this mode were to be used then preferably many of the elements of the primary circuit can be re-used, e.g. the 'H' bridge circuit that is used as the 'chopper' in the first part can be utilised as an active synchronous rectifier (controlled by the voltage monitoring circuit and the control logic). Preferably the secondary side control logic can, by virtue of its access to the 'H' bridge, modulate the impedance of the load that can in turn be read as data by the circuit in the first part.

Preferably, this arrangement permits data to be transferred in both directions across the connector. Furthermore, the connector enables data to be transferred in both directions whilst the connector is transferring power in one direction.

Where multiple signals are to be transferred by the connector, the data may preferably be multiplexed by time, frequency or phase. A composite signal can be transferred directly over the connector, suitably without multiplexing.

BRIEF DESCRIPTION OF THE DRAWINGS

The invention will now be described by way of example only with reference to the accompanying figures in which:

FIG. 1A is a cross-section of FIG. 1B at line A-A;

FIG. 2B is a cross-section of FIG. 2A at line A-A;

FIG. 3A is a plan view of the socket portion, FIG. 3B is an elevation of the socket portion showing some internal detail and FIG. 3C is a section view of the assembled connector;

FIGS. 4A and 4B show a capacitive connector of the present invention having embedded capacitor plates, where FIG. 4A is a perspective view of the tongue portion and FIG. 4B is a schematic section view of the assembled connector;

FIGS. 5A and 5B show a capacitive connector of the present invention having concentric rings, where FIG. 5A is a perspective view of the tongue portion and FIG. 5B is a schematic of the assembled ring structure;

DETAILED DESCRIPTION

Figure 1:
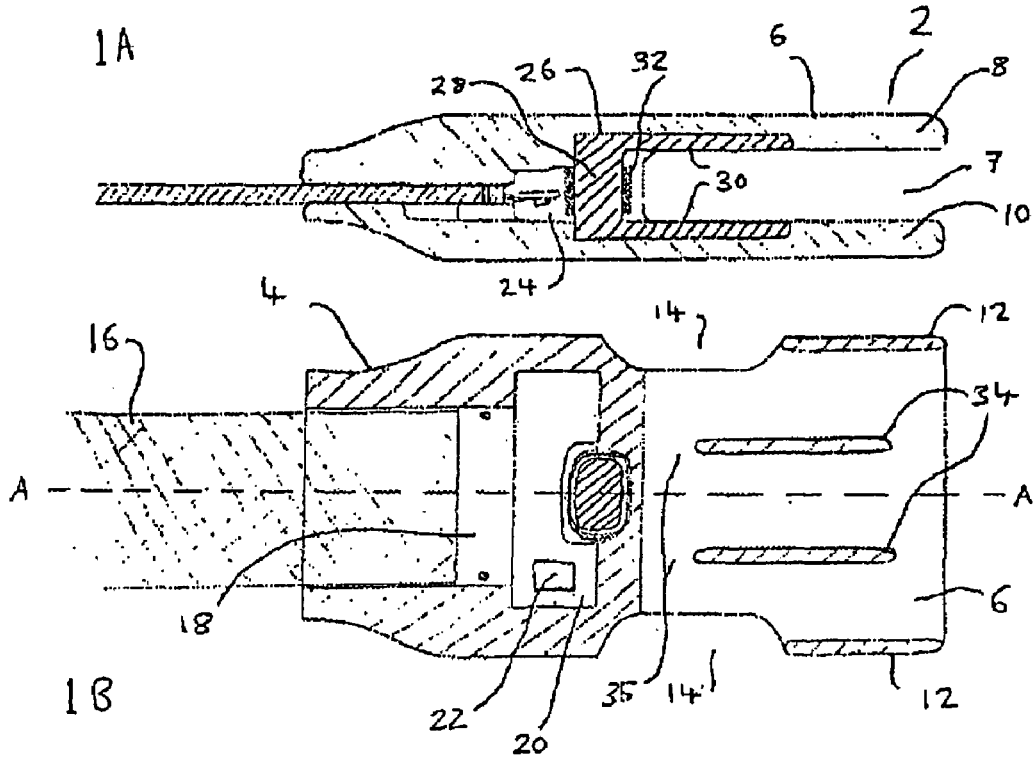
FIGS. 1A and 1B shows a socket portion of a contact-less inductive connector of the present invention, where

FIG. 1 shows the socket portion 2 of a contact-less connector of the present invention. The connector has a structure similar to that of a squeeze-to-release clip or buckle commonly found on rucksacks (see tongue portion 40 in FIG. 2). The socket portion has a base 4 and walls 6 extending from the base to define a socket 7. The socket portion has a flat profile that makes it more comfortable when worn or carried by an individual. The socket walls include opposing upper 8 and lower 10 walls that extend from the base and two opposing side walls 12 which extend from the mouth of the socket to about midway along the length of the socket. This arrangement provides a gap 14 in each side of the socket between the base 4 and side walls 12. These gaps act as detents that co-operate with latches 56 on the tongue portion (see FIG. 2). The detents may also, for example, be provided by apertures or openings in the socket walls or, for example, depressions in or projections on a surface of the socket walls. Preferably, a further advantage of providing gaps, apertures or openings in the socket walls is that dust, dirt and debris which may collect in the socket can escape from the socket through the apertures whilst the tongue is engaged in the socket.

A webbing strap 16 containing embedded wires is joined to the base. This webbing strap has a number of advantages; in particular it combines mechanical strength with electrical conductivity. The electrical wires may, for example, be incorporated into the weave of the strap as the warp or weft. Another example of a webbing strap is one where the webbing acts as a conduit or carrier for the electrical wires. Within the base the webbing is secured by a clamp 18. The base contains electronic circuitry 20 that drives the coupling element and also circuitry 22 that detects the presence of the coupling element in the tongue when it is engaged in the socket. A potting compound 24 may, for example, be used to surround the electrical wires within the connector.

The socket portion 2 contains an inductive coupling element 26 that includes a ferromagnetic core having a main part 28 and elongate arms 30. Conductive wires are wound around the main part 28 to form a conductive coil 32. The main part 28 and the coil 32 are located in the base 4 and the elongate arms 30 extend from the base along the upper 8 and lower 10 socket walls. The elongate arms 30 may extend, for example, to a point about half way between the base and the mouth of the socket. In some embodiments the elongate arms may extend to the mouth of the socket.

This arrangement provides an extended induction zone within the socket; provided the inductive element of the tongue is located within this zone there will be sufficient electromagnetic coupling to permit the transfer of data and/or power.

The connector has a self-cleaning structure which is provided by, for example, two internal walls 34 within the socket that extend from near the mouth of the socket to a point spaced from the base 4. As well as providing a self-cleaning structure, these internal walls may, for example, define a guide channel for locating the tongue within the socket. There are gaps 35 between the internal walls and the base and any debris that is forced into the socket by the piston action of the tongue will be removed from the guide channel through this gap 35. Preferably, any such debris can then escape from the connector via gaps 14 in the outer walls of the socket.

Figure 2:
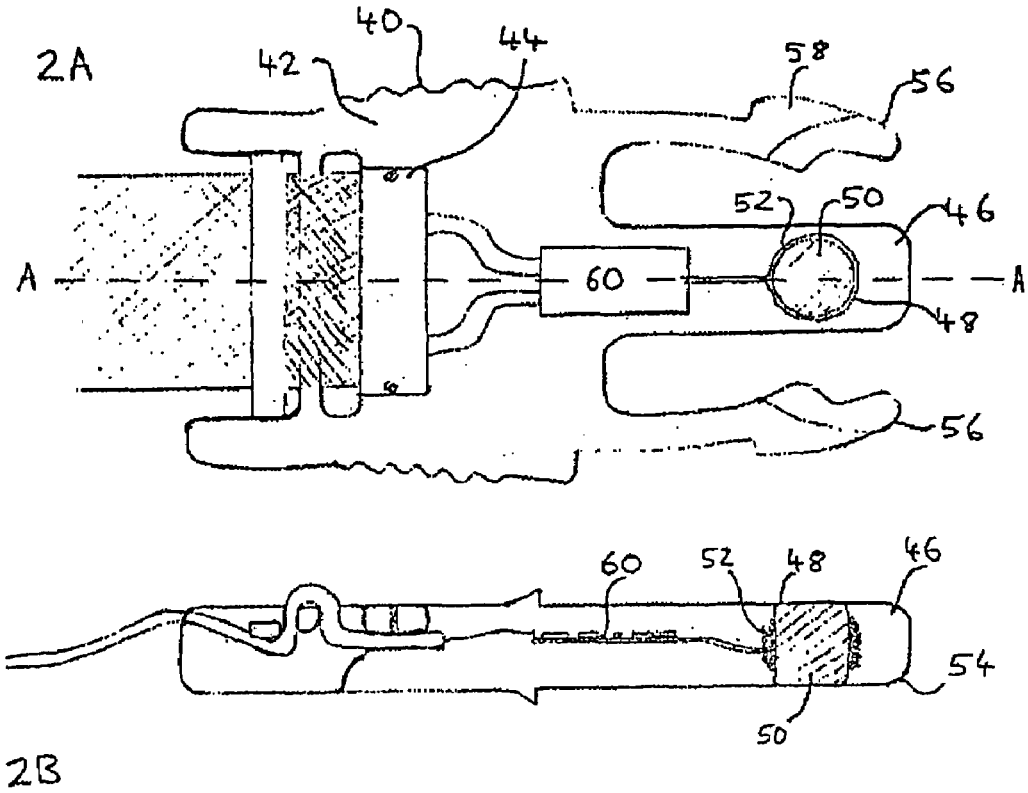
FIGS. 2A and 2B shows a tongue portion of a contact-less inductive connector of the present invention, where

FIG. 2 shows the tongue portion 40 of a contact-less inductive connector of the present invention and is the co-operating other half of the socket portion 2 shown in FIG. 1. The tongue portion 40 includes a base 42 that contains a clamp 44 for securing a webbing strap. A tongue 46 extends from the base 42 and contains an inductor element 48. The inductor element 48 may be located anywhere within the tongue and may, for example, be located in a forward part of the tongue or even, for example, close to the tip of the tongue.

The inductor has a ferromagnetic core 50 that may, for example, be cylindrical, but preferably has a "bobbin" or "cotton reel" geometry, that extends across the thickness of the tongue from an upper surface of the tongue to a lower surface of the tongue. The ends of the core may, for example, be located just below the surface of the tongue so that the core may be protected by a layer of, for example, plastics material. In the case of a "bobbin" or "cotton reel" geometry the ends of the core are suitably flared so as to maximise the overlap with the corresponding inductor core in the other half of the connector. The flared ends are preferably shaped so as to optimise overlap with the inductor in the socket portion, for example they may be of a square section, suitably with rounded corners.

Wound around the core is a conductive coil 52. As noted above, in preferred embodiments the ends of the core are flared to produce a large surface area at, for example, the upper and lower surfaces of the tongue so that there is greater overlap with the inductor in the socket walls.

When the tongue is engaged in the socket 7 the inductor 48 is located between the two elongate arms 30 of the socket portion. The dimensions of the elongate arms 30 and the inductor 48 are such that there is considerable freedom in the location of the tongue 46 within the socket 7 whilst coupling is maintained. The dimensions of the elongate arms and the inductor in the tongue may be selected so as to optimise this advantage.

The tongue 46 typically has a slightly rounded forward portion 54 to aid its entry into the guide channel defined by internal walls 34. The rounded surfaces 54 also facilitate the removal of debris from the guide channel during connection.

The locking means includes two sprung latches 56 located on either side of the tongue 40 and extending from the base 42, which latches co-operate with the gaps 14 in the socket walls 6 to provide "quick release" locking means. As noted above this arrangement provides a mechanical connector similar to the press-sides-to-release clip found on rucksacks.

The latches 56 are, for example, made from a resilient plastic and it is this resilience that suitably provides the spring action of the two latches in use. The latches are typically biased to a "wide" position so that when the tongue is engaged in the socket lobes 58 extend through the gaps 14 in the socket walls to hold the tongue 46 within the socket 7. In order to remove the tongue it is necessary to apply force to the lobes 58 against the bias of the latches so as to retract the lobes 58 so that the tongue can be withdrawn.

When the two separate parts of the connector are to be engaged, the tongue 46 may be inserted directly into the socket 7 because the socket walls 6 act on the curved outer surfaces of the latches 58 to force the latches together. Once the tongue is fully engaged, the latches 56 will "snap" into place in the gaps 14 to hold the tongue 46 within the socket 7.

The tongue portion 40 includes electrical circuitry 60 for controlling the inductor coil, for example a bridge rectifier. Typically, the circuitry is rather similar to circuitry found in switch mode power supplies.

Figure 3:
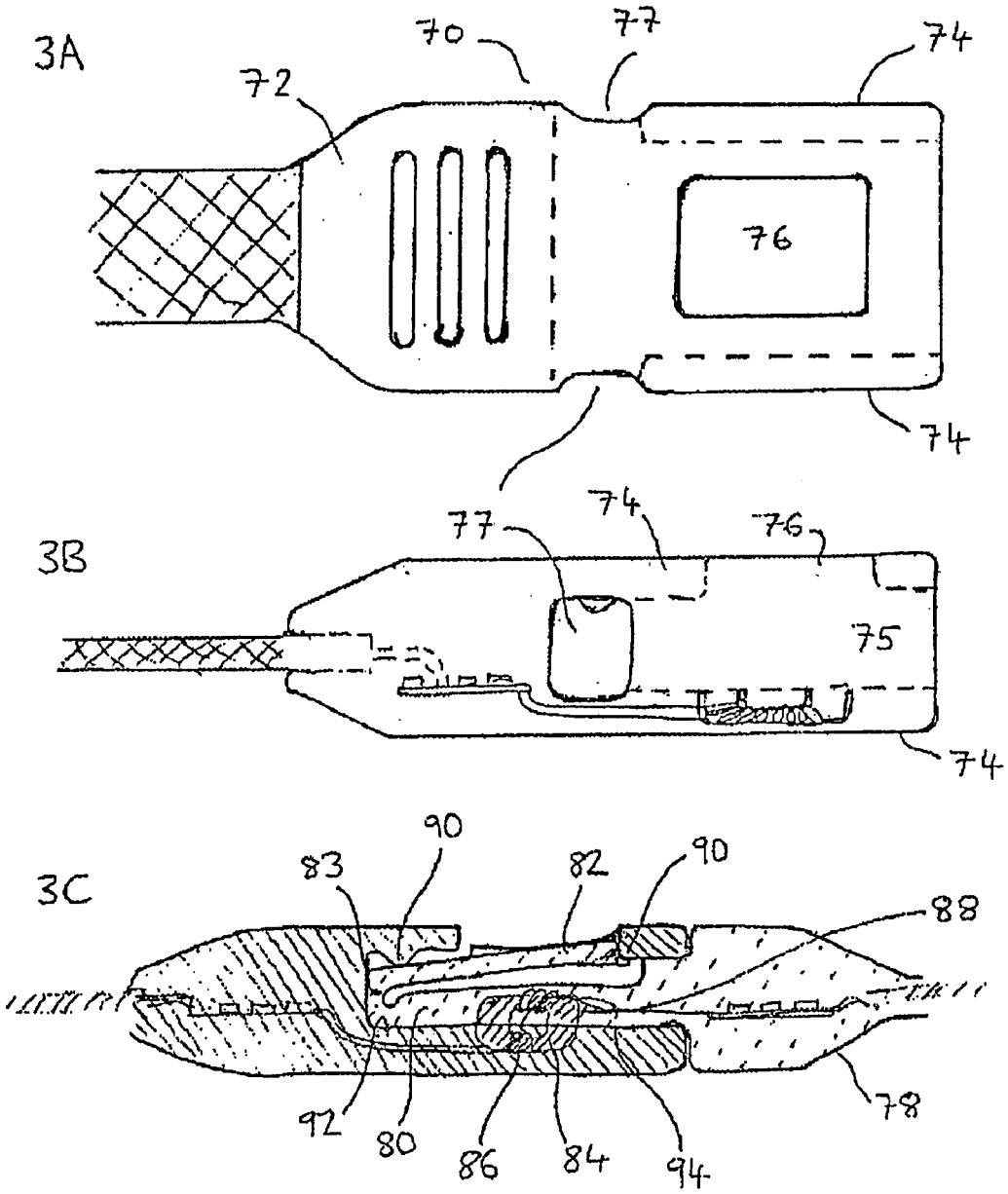
FIGS. 3A to 3C show an inductive connector of the present invention wherein the connector has a central latch locking means, where

FIGS. 3A to 3C show an electrical connector of the present invention in which the locking mechanism includes a single latch. This embodiment has a flat profile and illustrates the use of a central latch mechanism for providing "quick release" functionality. The socket portion 70 shown in FIGS. 3A and 3B has a base 72 and four walls 74 defining a socket 75. There is an opening 76 in the upper socket wall. There are also apertures 77 in the side walls of the socket near the base of the socket portion through which dust and debris can escape from the socket.

The tongue portion 78 shown in FIG. 3C includes a tongue 80 which has an integral sprung latch 82 that co-operates with the opening 76 in the socket wall when the tongue 80 is engaged in the socket 75. The latch 82 is, for example, formed as a folded back extension of the tongue and this arrangement simplifies manufacture. For example, the tongue 80 and latch 82 are joined by a body of resilient material 83 that provides a spring action to the latch. The latch is biased to an "up" position. Preferably the tongue and latch are a unitary piece and are made from the same material.

When the tongue is engaged in the socket, the latch 82 extends into the opening 76 by virtue of its bias. The socket wall 74 acts against the latch 82 to hold the tongue 80 in place. In order to remove the tongue 80 from the socket 75 it is necessary to apply force to the latch 82 in a downwards direction against its bias so that the latch 82 retracts from the opening 76 and the tongue 80 can then be pulled clear of the socket 75.

In contrast to the socket portion of FIG. 1, the inductor in the socket portion of this embodiment is located in the lower wall of the socket and comprises, for example, a half-toroid ferromagnetic core 84 with a conductive coil 86 wound around the core 84.

The tongue 80 contains an inductor element 88 that, for example, has the same half-toroid geometry as the inductor in the socket portion 70. When the tongue 80 is engaged in the socket, the two half-toroid inductor elements overlap to provide a toroidal inductor as shown in FIG. 3C. This overlap permits some movement of the tongue in the direction of engagement whilst maintaining efficient electrical connection.

An additional advantage of this type of electrical connector is that when the tongue 80 and socket 75 are engaged the latch 82 pushes, for example, against shoulders 90 on the socket portion 70, for example on the socket walls 74 as shown in FIG. 3C, and this has the effect of pushing the lower surface 92 of the tongue against the corresponding inner surface 94 of the socket. This ensures close contact between the two surfaces and helps to exclude dirt and dust and so permits efficient electromagnetic coupling.

FIGS. 4A and 4B show a tongue portion of an electrical connector of the present invention in which transmission of data and/or power is achieved by capacitive coupling. The overall structure of the connector is that of a squeeze-sides-to-release clip similar to that shown in FIGS. 1 and 2 and discussed above.

In this embodiment electromagnetic coupling is achieved with capacitors rather than inductors. A number of capacitor plates 100 are provided on the tongue 101, for example, just below the surface of the tongue 101 and a number of complimentary plates 102 provided, for example, just below the surface of corresponding inner surfaces of the socket walls 104. When the tongue is engaged in the socket, the pairs of plates overlap and a capacitor structure comprising two conductive plates separated by a dielectric layer is formed.

FIGS. 5A and 5B show an alternative arrangement for providing capacitive coupling. In this embodiment the tongue 110 has, for example, a substantially rectangular cross-section and contains four capacitor rings 112 extending around the circumference of the tongue, located just below the surface of the tongue and spaced along the length of the tongue.

The socket portion, for example, contains complimentary capacitor rings 114 within the walls that define the socket or guide channel so that when the tongue is engaged in the socket the capacitor rings of the tongue are located within the capacitor rings of the socket. This concentric ring arrangement may provide multiple capacitor structures and has the advantage that electromagnetic coupling can be achieved with some flexibility as to the precise location of the tongue in the socket.

Figure 6:
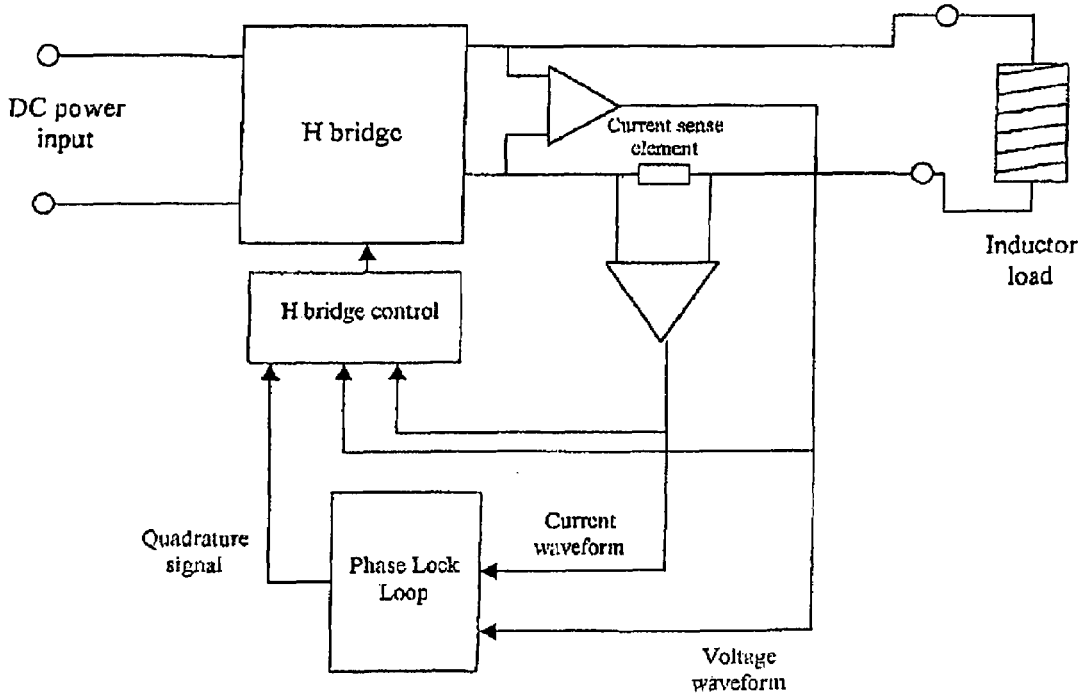
FIG. 6 shows an electronic circuit that may be used to drive a primary inductive element.

FIG. 6 shows an example of control circuitry that could be used to control one half of the connector. The circuit is suitable for controlling the part of the connector that is transmitting or broadcasting the data and/or power.

For example, where the connector transfers power from the primary side to the secondary side and data (for example, a digital serial message) is required to be passed in the same direction, then if the power transfer was taking place at a frequency of 200 kHz, the data could be encoded to alternate the power transfer frequency between two distinct values e.g. 195 and 205 kHz. Preferably, this would be detected at the secondary side and the data extracted.

Alternatively the primary drive waveform could be the message itself by transmitting the power carrier waveform as a serial code (this would require the code to have a balanced average waveform so as to not saturate the core).

If required, feedback from the secondary side could then take place by modulation of the effective load, which in turn could be monitored by circuitry in the primary side.

Figure 7:
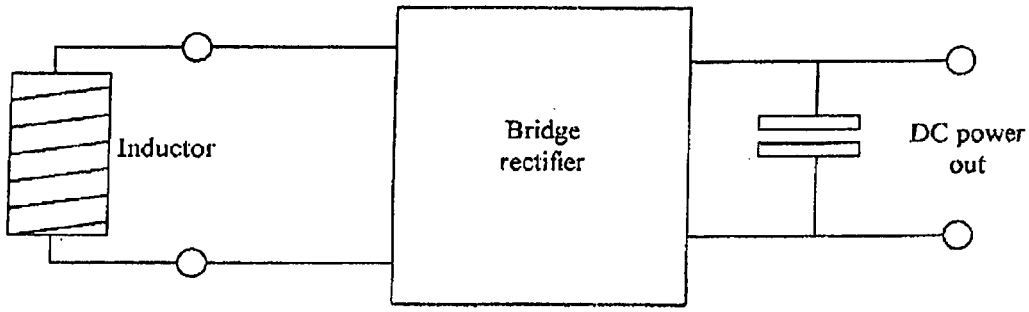
FIG. 7 shows a simple electronic circuit that may be used to drive a secondary inductive element.

FIG. 7 shows an example of simple circuitry that could be used to control the part of the connector that is receiving the data and/or power transmitted by the other half of the connector.

Figure 8:
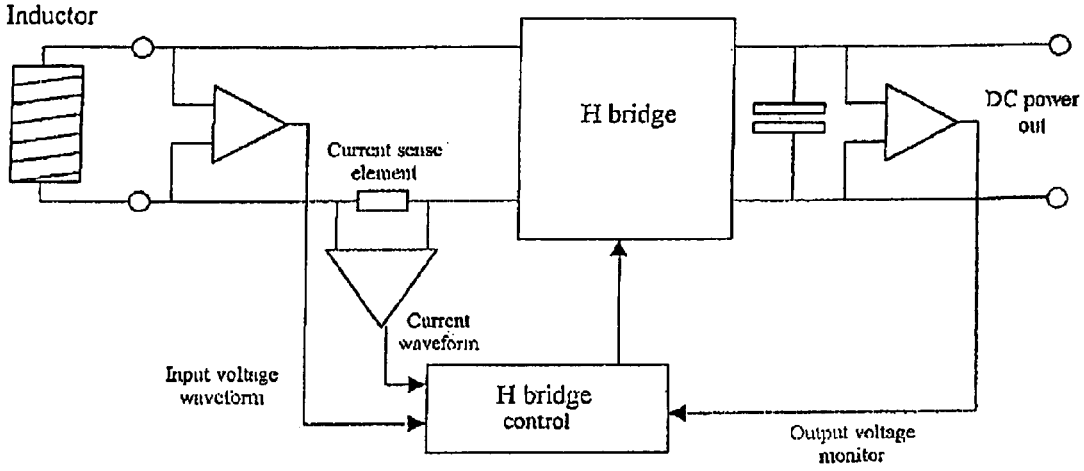
FIG. 8 shows a more complex electronic circuit that may be used to drive a secondary inductive element.

FIG. 8 shows an example of more complex control circuitry for controlling the "receiving" part of the connector. This sort of circuit permits data extraction and regulation of the DC output.

The invention claimed is:

1. A two-part electrical connector, comprising:

a first part including a tongue portion having a base and a tongue extending longitudinally therefrom;

a second part including a socket portion having a base and walls extending therefrom defining a socket for slidably receiving the tongue, the tongue portion and socket portion having locking means to permit releasable mutual engagement, said locking means including a locking member moveable between a first position in which the tongue is held in the socket and a second position in which the tongue is removable from the socket;

a primary coupling element located in the tongue; and a secondary coupling element located in at least one of the socket walls, which elements provide a contact-less electromagnetic coupling when the tongue is engaged in the socket, wherein the primary and secondary coupling elements are primary and secondary inductors, respectively, and each includes a conductive coil wound around a ferromagnetic core, and the secondary conductive coil is located in the socket base and the secondary inductor core has two elongate arms extending into the socket walls so that when the tongue is engaged in the socket, the primary inductor is located between the two arms.

2. The two-part electrical connector according to claim 1, wherein the primary coupling element extends longitudinally adjacent an outer surface of the tongue and the secondary coupling element extends longitudinally adjacent a corresponding inner surface of a socket wall so that in use overlap of the primary and secondary coupling elements permits lateral and/or longitudinal movement of the tongue within the socket while maintaining electromagnetic coupling.

3. The two-part electrical connector according to claim 1, wherein the primary inductor coil is located in a rear portion of the tongue and the primary inductor core has two elongate arms extending to a forward portion of the tongue so that when the tongue is engaged in the socket, the primary inductor arms are located between and overlap with the secondary inductor arms.

4. The two-part electrical connector according to claim 1, wherein at least one of the elongate arms is spaced from the rest of the core to permit independent movement of the elongate arm with respect to the rest of the core whilst in electromagnetic communication with the rest of the core.

5. The two-part electrical connector according to claim 1, wherein the primary and secondary cores are made from a ferrite material.

6. Use of a two-part electrical connector according to claim 1 to transmit electrical signals between electrical equipment.

7. The two-part electrical connector according to claim 5, wherein the primary core and the secondary core are made from ferrite particles dispersed in a resilient matrix.

8. A two-part electrical connector comprising:

a first part being a tongue portion having a base and a tongue extending longitudinally therefrom;

a second part being a socket portion having a base and walls extending therefrom defining a socket for slidably receiving the tongue, the tongue portion and socket portion having locking means to permit releasable mutual engagement, said locking means including a locking member moveable between a first position in which the tongue is held in the socket and a second position in which the tongue is removable from the socket;

a primary coupling element located in the tongue; and a secondary coupling element located in at least one of the socket walls, which elements provide a contact-less electromagnetic coupling when the tongue is engaged in the socket, wherein each of the primary and secondary elements is one half of a capacitor structure so that when the tongue is engaged in the socket a capacitor structure is formed to enable capacitive coupling.

9. The two-part electrical connector according to claim 8, wherein each of the primary and secondary coupling elements is a capacitor plate such that when the tongue is engaged in the socket there is overlap of the primary and secondary capacitor plates.

10. The two-part electrical connector according to claim 8, wherein the primary coupling element extends longitudinally adjacent an outer surface of the tongue and the secondary coupling element extends longitudinally adjacent a corresponding inner surface of a socket wall so that in use overlap of the primary and secondary coupling elements permits lateral and/or longitudinal movement of the tongue within the socket whilst maintaining electromagnetic coupling.

11. Use of a two-part electrical connector according to claim 8 to transmit electrical signals between electrical equipment.

12. A two-part electrical connector comprising:

a first part being a tongue portion having a base and a tongue extending longitudinally therefrom;

a second part being a socket portion having a base and walls extending therefrom defining a socket for slidably receiving the tongue, the tongue portion and socket portion having locking means to permit releasable mutual engagement, said locking means including a locking member moveable between a first position in which the tongue is held in the socket and a second position in which the tongue is removable from the socket;

a primary coupling element located in the tongue; and a secondary coupling element located in at least one of the socket walls, which elements provide a contact-less electromagnetic coupling when the tongue is engaged in the socket, wherein at least one of the socket walls contains an aperture adjacent the socket base so that dirt and dust can escape from the socket when the tongue is engaged in the socket.

13. The two-part electrical connector according to claim 12, wherein the locking means includes a resilient latch and a detent for cooperating with the latch.

14. A tongue portion for use in a two-part electrical connector according to claim 12, wherein the tongue portion includes a base and a tongue extending longitudinally therefrom, an electromagnetic coupling element located within the tongue, and locking means for co-operating with locking means of the socket portion for releasably holding the tongue in the socket.

15. A socket portion for use in a two-part electrical connector according to claim 12, wherein the socket portion includes a base and socket walls extending longitudinally therefrom to define a socket for slidably receiving a tongue, an electromagnetic coupling element located within at least one of the socket walls and locking means for co-operating with locking means of the tongue portion for releasably holding the tongue in the socket.

16. The two-part electrical connector according to claim 13, wherein the resilient latch is located on the tongue and the detent is located in a corresponding socket wall.

17. The two-part electrical connector according to claim 13, wherein the tongue portion has two resilient latches spaced laterally from and located on either side of the tongue and the socket portion has two detents located in corresponding socket walls.

18. A two-part electrical connector comprising:

a first part being a tongue portion having a base and a tongue extending longitudinally therefrom;

a second part being a socket portion having a base and walls extending therefrom defining a socket for slidably receiving the tongue, the tongue portion and socket portion having locking means to permit releasable mutual engagement, said locking means including a locking member moveable between a first position in which the tongue is held in the socket and a second position in which the tongue is removable from the socket;

a primary coupling element located in the tongue; and a secondary coupling element located in at least one of the socket walls, which elements provide a contact-less electromagnetic coupling when the tongue is engaged in the socket, wherein the socket portion includes two baffles located within the socket defining a guide channel for guiding the tongue, the baffles extending from the mouth end of the socket to a point spaced from the base of the socket portion so that dirt and debris pushed into the guide channel by the tongue can escape from the guide channel through the space between the socket base and the baffles.

19. Apparatus for transmitting electrical signals between electrical equipment, including a two-part electrical connector comprising:

a first part being a tongue portion having a base and a tongue extending longitudinally therefrom;

a second part being a socket portion having a base and walls extending therefrom defining a socket for slidably receiving the tongue, the tongue portion and socket portion having locking means to permit releasable mutual engagement, said locking means including a locking member moveable between a first position in which the tongue is held in the socket and a second position in which the tongue is removable from the socket;

a primary coupling element located in the tongue; and a secondary coupling element located in at least one of the socket walls, which elements provide a contact-less electromagnetic coupling when the tongue is engaged in the socket, wherein the apparatus further comprises a webbing strap connected to at least one part of the connector, wherein the webbing strap included electrical wires which are electrically connected to a coupling element in the connector.

20. A method of modulating the current characteristics in one or both of the primary and secondary coupling elements in a two-part electrical connector said connector comprising:

a first part being a tongue portion having a base and a tongue extending longitudinally therefrom;

a second part being a socket portion having a base and walls extending therefrom defining a socket for slidably receiving the tongue, the tongue portion and socket portion having locking means to permit releasable mutual engagement, said locking means including a locking member moveable between a first position in which the tongue is held in the socket and a second position in which the tongue is removable from the socket;

a primary coupling element located in the tongue; and a secondary coupling element located in at least one of the socket walls, which elements provide a contact-less electromagnetic coupling when the tongue is engaged in the socket, said method including the steps of:

detecting the engagement status of the connector and adjusting the current characteristics in response to the detected status.

21. The method according to claim 20, wherein the engagement status is detected by detecting the change in impedance when the two-part connector is connected or disconnected.

22. The method according to claim 20, wherein the engagement status is detected by detecting the change in phase between current and voltage when the two-part connector is connected or disconnected.

* * * * *